US005218909A

United States Patent [19]

Ng

[11] Patent Number: 5,218,909

[45] Date of Patent: Jun. 15, 1993

[54] SLOT TRACK RACING APPARATUS

[76] Inventor: Cody K. M. Ng, 63 Sheung Shing Street, Tiptop Mansion, 2/F, Homantin Kowloon, Hong Kong

[21] Appl. No.: 871,844

[22] Filed: Apr. 21, 1992

[51] Int. Cl.[5] ..... A63G 25/00

[52] U.S. Cl. ..... 104/60; 104/295; 104/296; 104/305; 238/10 F

[58] Field of Search ..... 104/DIG. 1, 140, 141, 104/145, 53, 60, 295, 296, 300, 305, 304, 1.5; 238/10 A, 10 B, 10 C, 10 F

[56] References Cited

U.S. PATENT DOCUMENTS

| | | | |
|---|---|---|---|
| 3,291,392 | 12/1966 | Cramer | 104/60 |
| 3,313,242 | 4/1967 | Voce | 104/60 |
| 3,377,958 | 4/1968 | Bax et al. | 104/60 |
| 3,410,223 | 11/1968 | Miller | 104/60 |
| 3,674,269 | 4/1972 | Cooper et al. | 104/60 |
| 4,854,909 | 8/1989 | Ichimoto | 104/305 |
| 5,016,540 | 5/1991 | Barber | 104/302 |

FOREIGN PATENT DOCUMENTS

| | | | |
|---|---|---|---|
| 1355910 | 2/1964 | France | 104/305 |

*Primary Examiner*—Mark T. Le
*Attorney, Agent, or Firm*—Seed and Berry

[57] ABSTRACT

Slot racing track apparatus comprises a base member, first and second slot defining respective lanes and at least one lane changing slot connecting the first and second slots together. A lane changing member is disposed at a junction between the lane defining slots and the lane changing slot and a racing vehicle for use on the track is provided with a guide member for engagement in the slots, the degree of protrusion of the guide member into the slots being controlled so that the lane changing member may be selectively engaged by the vehicle so that the vehicle may change lane.

19 Claims, 7 Drawing Sheets

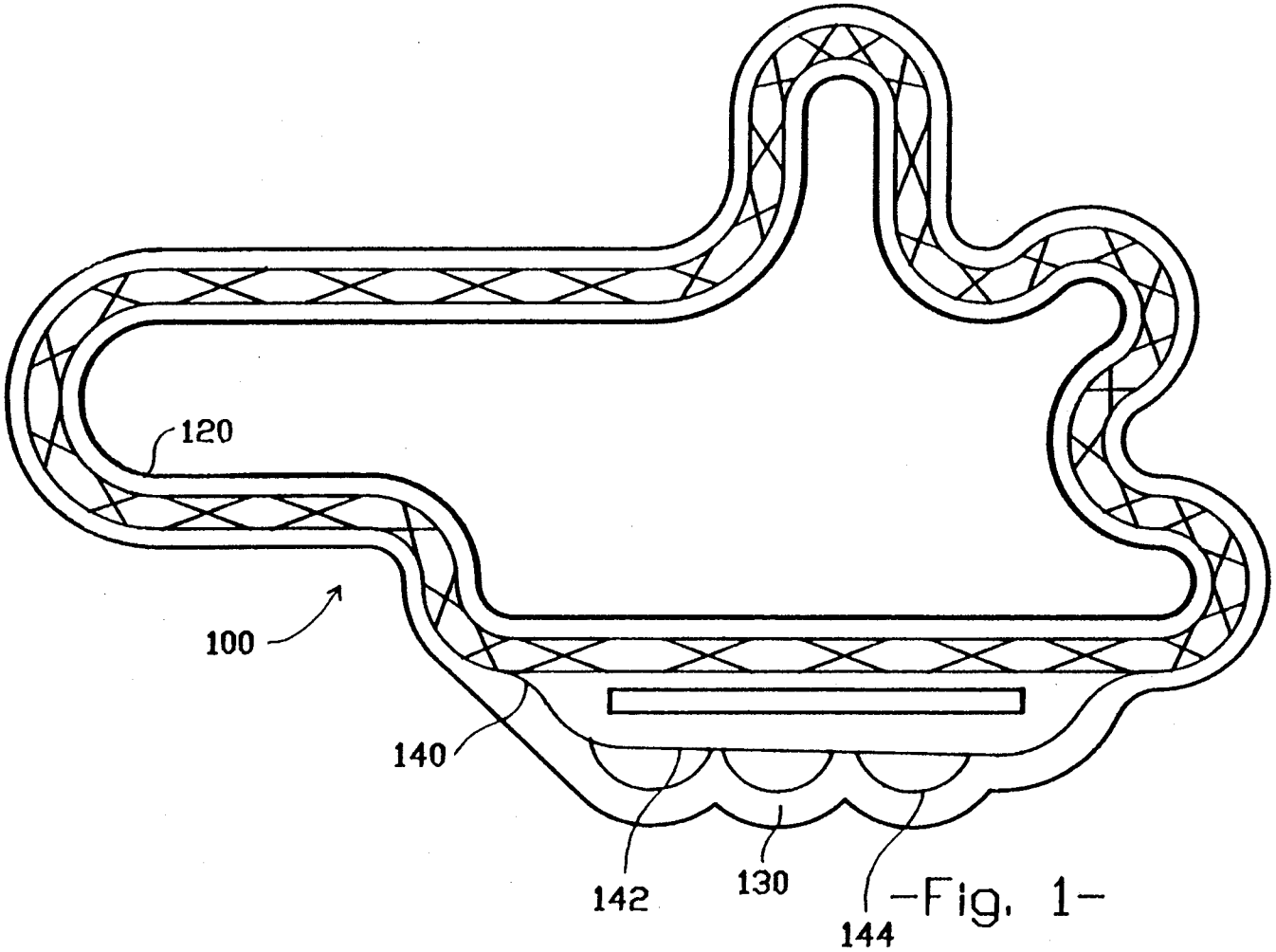
-Fig. 1-

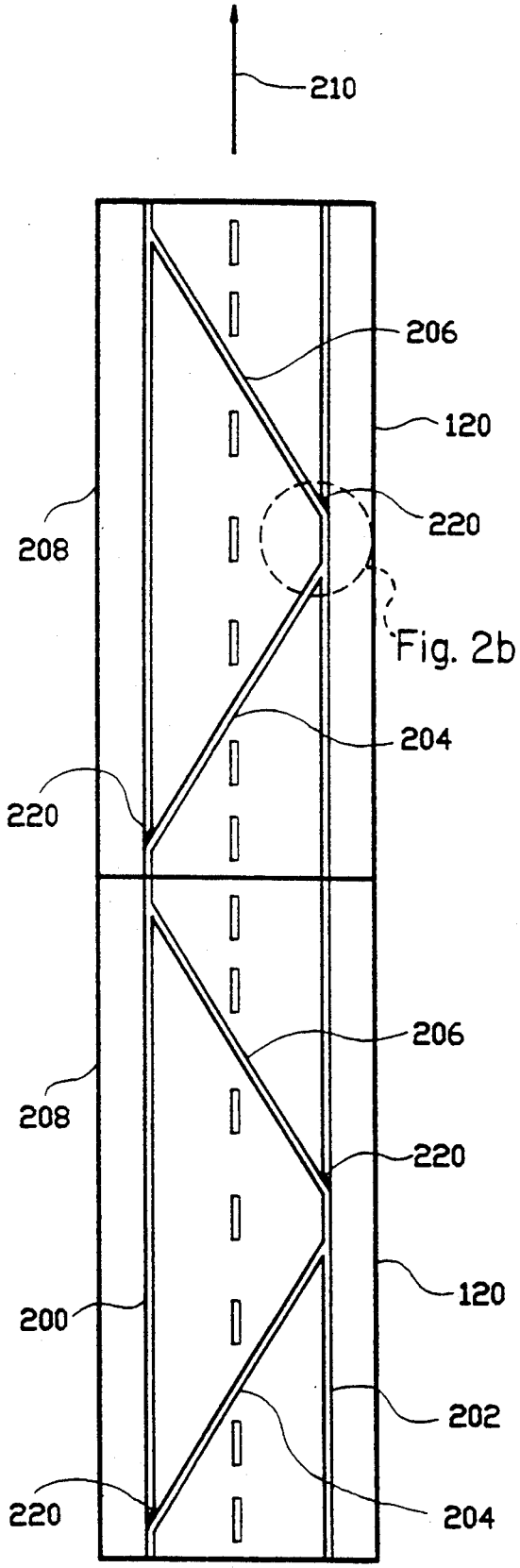
-Fig. 2a-
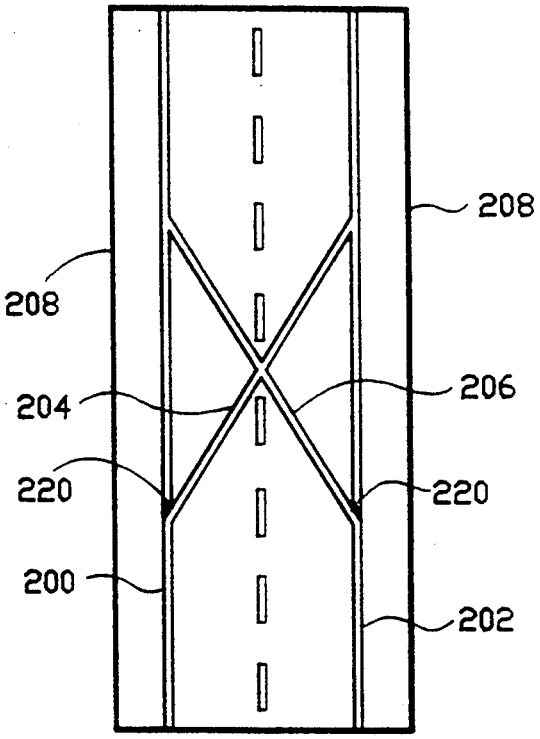
-Fig.3-

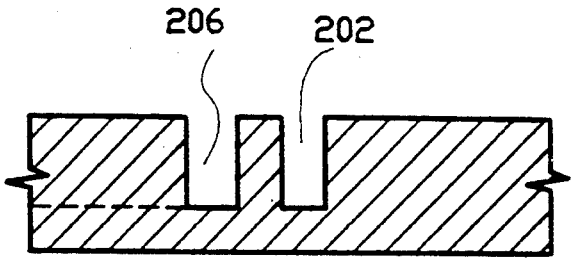
-Fig.2c-
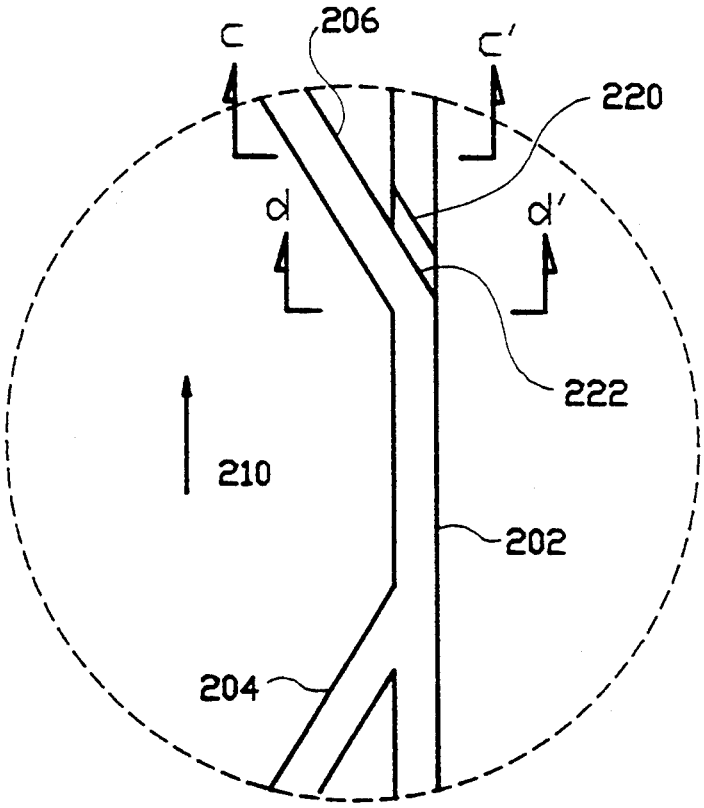
-Fig.2b-
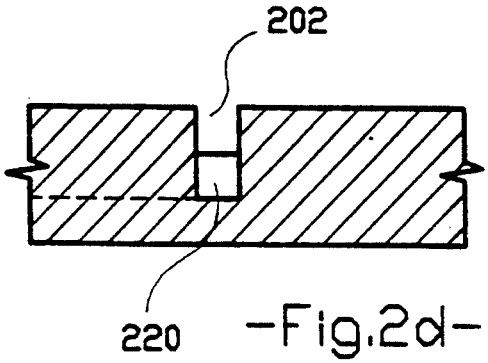
-Fig.2d-

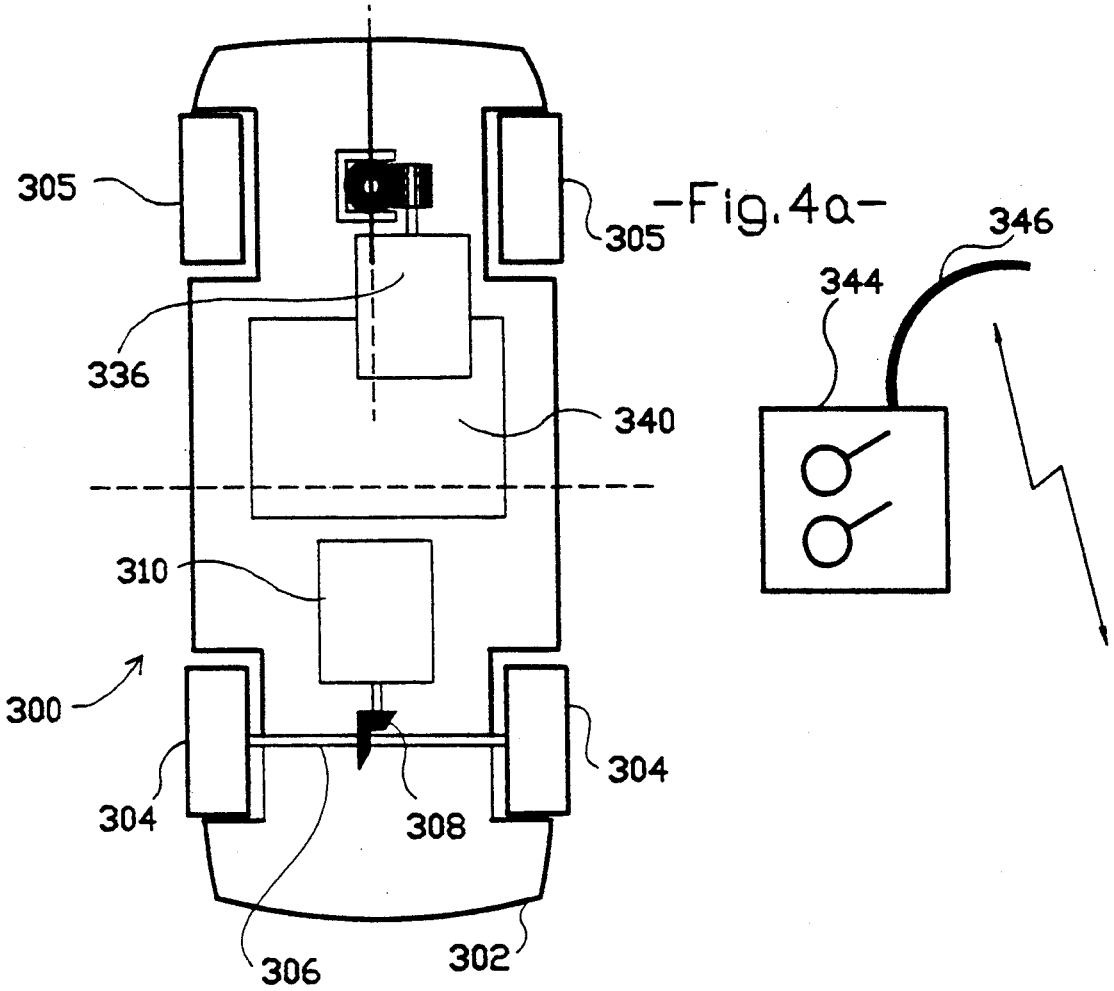
-Fig. 4a-
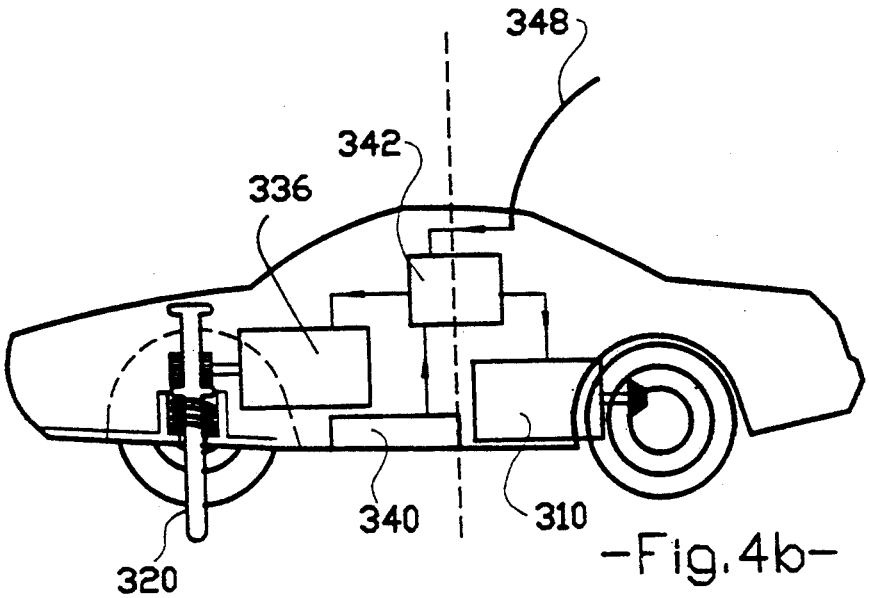
-Fig. 4b-

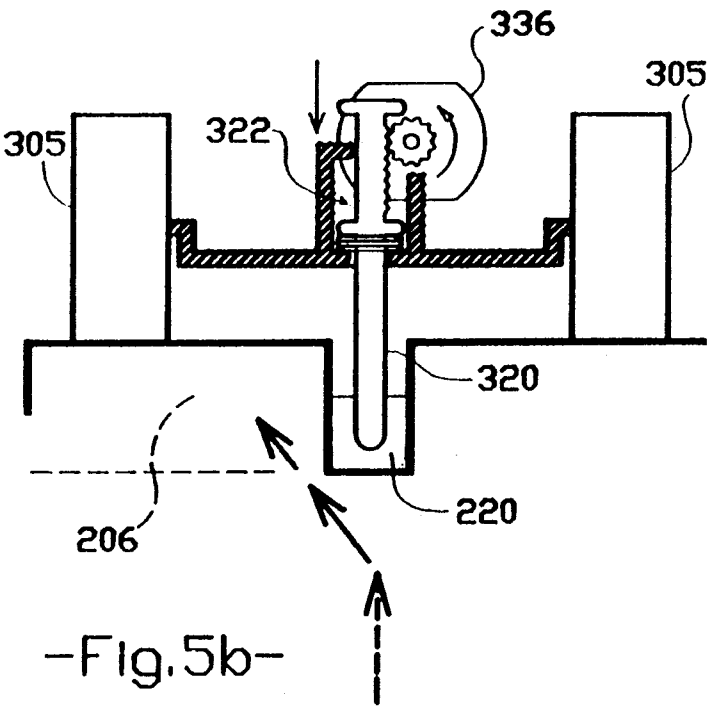
-Fig.5b-
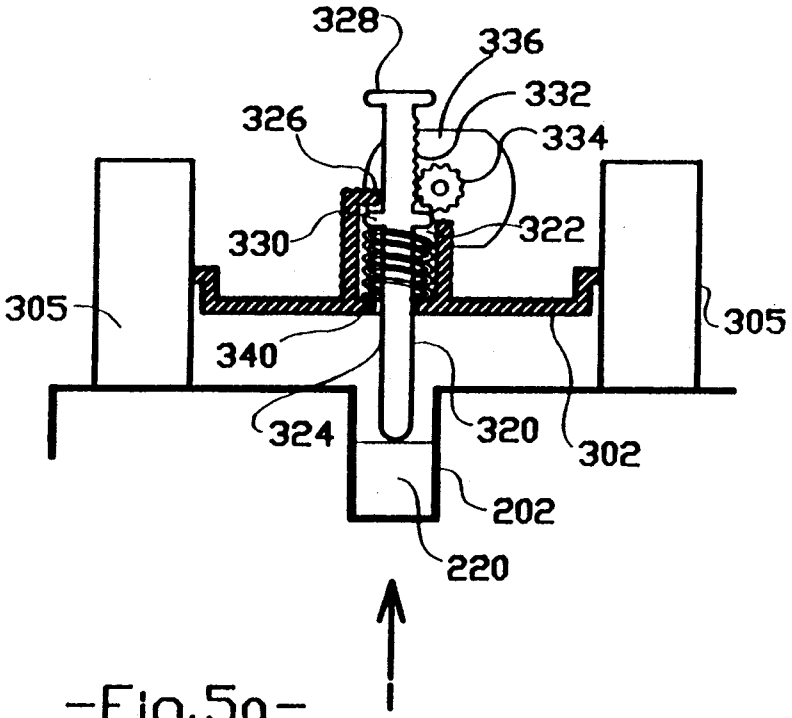
-Fig.5a-

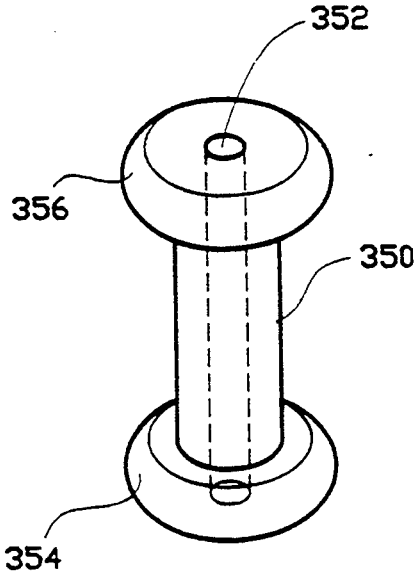
-Fig.6a-
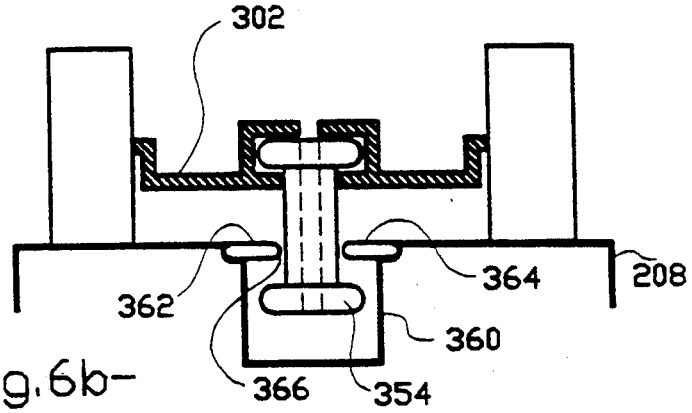
-Fig.6b-
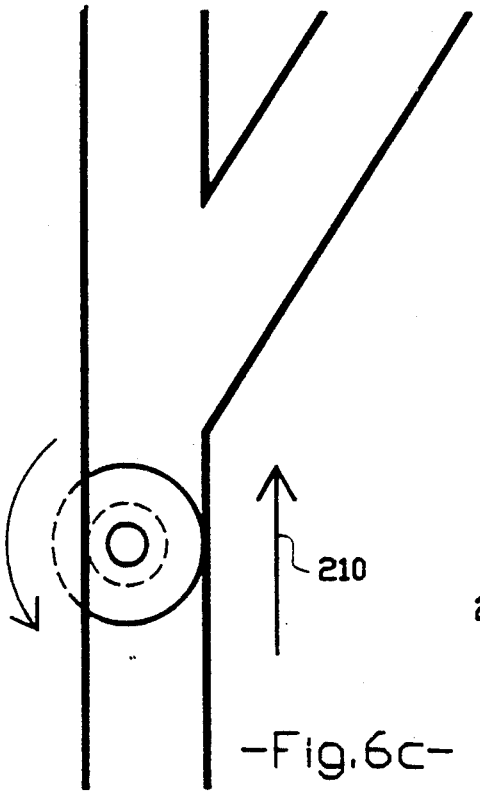
-Fig.6c-
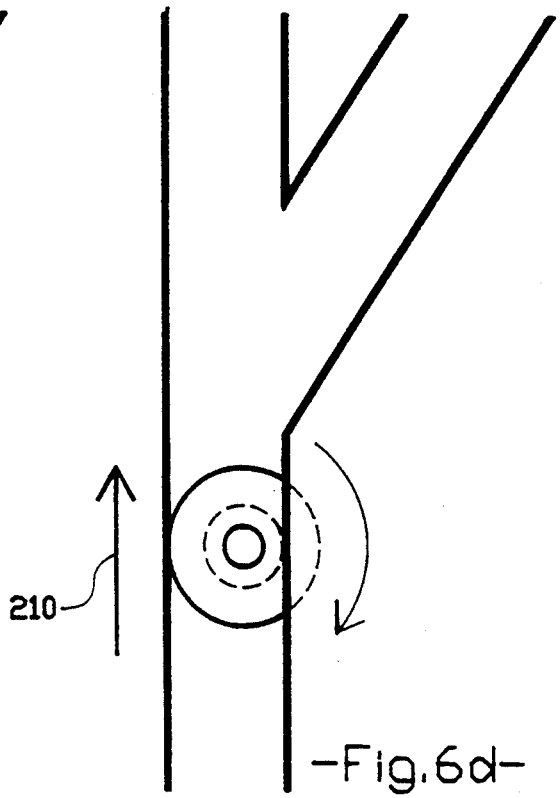
-Fig.6d-

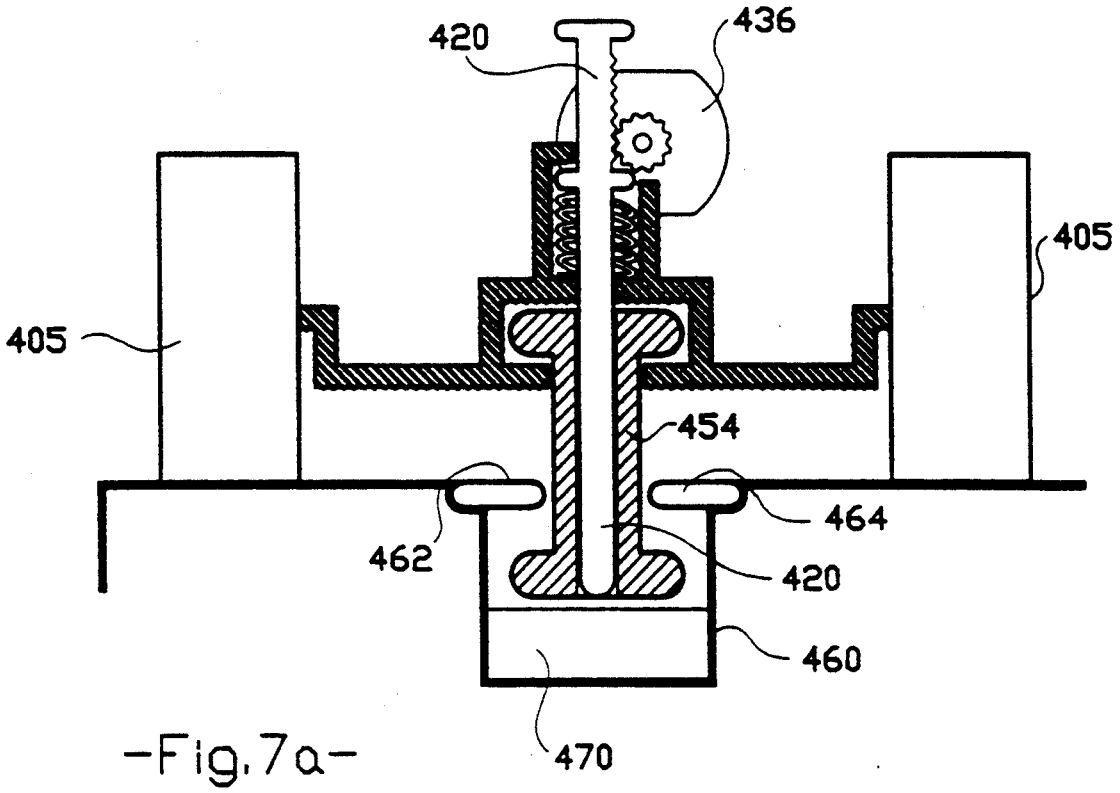
-Fig. 7a-
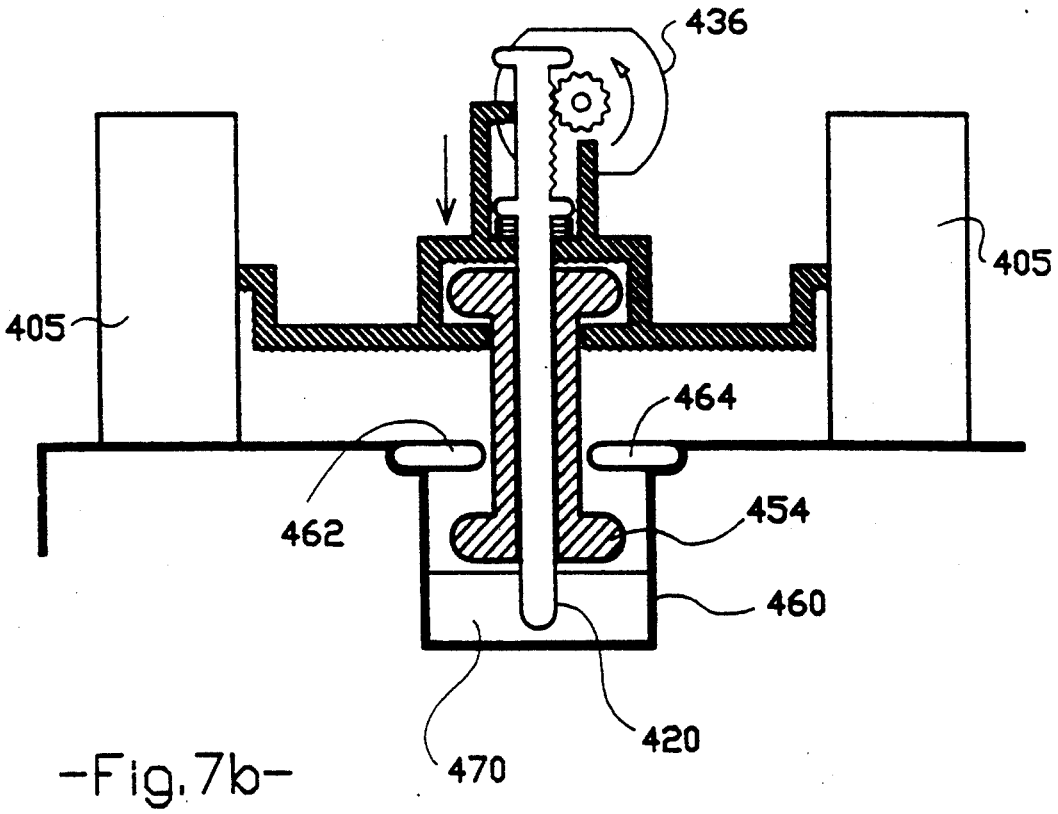
-Fig. 7b-

SLOT TRACK RACING APPARATUS

BACKGROUND AND FIELD OF THE INVENTION

This invention relates to slot track racing apparatus.

Slot car racing tracks are known. Such tracks generally comprise two or more lanes, each for a racing car model, the lanes being defined by a respective slot which is engaged by a guiding member of the racing model car. Power rails are provided on either side of each slot which engage with corresponding pickups on the model so that a driving motor in the model may be powered thereby. Each player has a controller which controls the power supply to the model and thus its speed.

The simplest form of such a slot racing track comprises a circuit in which the two lanes run parallel to one another. In order to increase the interest of the players, obstacles such as chicanes, bridges and crossovers may be provided. However, such a racing track has the disadvantage that the cars cannot change lane as each lane is associated with a power controller which is associated with a given car and only two cars, one per lane, may be controlled.

There has been proposed a racing track which allows model vehicles to change lane. The vehicles change from one lane to another by sliding across the track. Each lane is provided with two sets of power rails spaced by different distances, one for each car so that each car can use each lane without interference. The race track is consequently complicated and suffers the disadvantage that when changing lane the car speed is reduced because power is not provided. Furthermore, the mechanism used to allow lane changes involves turning the wheels of the car at a sharp angle and this has a braking effect on the car, thus reducing speed.

It is an object of the invention to provide slot track racing apparatus which alleviates the above disadvantages.

SUMMARY OF THE INVENTION

According to the invention there is provided in combination and separately, slot racing track apparatus comprising a base member, first and second slots defining respective lanes, at least one lane changing slot connecting the first and second slots together, lane changing means disposed at a junction between the lane defining slots and the lane changing slot and a racing vehicle for use on the track, the vehicle including a guide member for engagement in a said slot t be guided thereby.

Preferably the lane changing means comprises a lane changing member partially occluding the slot and the racing vehicle further includes means for controlling the degree of protrusion of the guide member into the slot, so that the lane changing member may be selectively engaged by the vehicle.

Preferably the racing vehicle is self powered and a remote control is provided for controlling both the controlling means of the racing vehicle and the speed of the vehicle.

The invention also provided a slot racing track in which the slot is partially covered to define a longitudinal opening narrower than the width of the slot for receiving a slot engagement member of a racing vehicle, the slot engagement member having a lip wider than the opening for retention in the slot. An arrangement of this nature allows the cars to be retained on the track at high speed, so that they will not fall off unlike prior art racing track vehicles.

Specific aspects and features of the invention include, in a first aspect a slot track racing apparatus comprising a base member, first and second slots defining respective lanes; and at least one lane changing slot connecting the first and second slots, in a second aspect a racing vehicle for use on the slotted track, the vehicle including a chassis, a guide member protruding below the chassis for engagement in the slot to be guided thereby and further comprising a motor for powering the vehicle and means for receiving a battery to power the vehicle and wireless control means for controlling the motor, in a third aspect a racing vehicle for use on a slotted track, the vehicle including a chassis and a guide member protruding below the chassis for engagement in the slot to be guided thereby and means for controlling the degree of protrusion of the guide member below the chassis, in a fourth aspect a slot racing track having a longitudinal slot for guiding a slot track racing vehicle, the slot being partially covered to define a longitudinal opening narrower than the width of the slot for receiving a slot engagement member of a said vehicle and, independently, a racing vehicle having a slot engagement member having a lip wider than the opening for retention in the slot and in a fifth aspect a slot track racing apparatus comprising a plurality of slot racing track sections connectable together which form a circuit preferably including a route changing section connected to the racing track sections, the route changing section being connected to an alternative track route which may preferably include a pit stop area.

The slot track racing apparatus of the embodiment of the invention provides an alternative approach to simulation of vehicle racing to the approaches of the prior art. Unlike the prior art, the lanes are not provided with power rails and, instead, the vehicles arc themselves self-powered and radio controlled, this simplifying the track structure to a considerable extent. The racing vehicles are guided by slots which define lanes on the track but lane changing slots are provided so that a player may take positional advantage on the track, by using the inner track on a bend, for example. The inclusion of a selective lane changer provided in the vehicle allows the vehicle remotely to follow one of the lane changing slots when the player desires to overtake or change lane to take positional advantage. Furthermore, the track design whereby a vehicle is locked on to the track can make the racing game faster and more exciting. A particular advantage of the lane changing feature of the track of the invention is that it allows branches in the track to be made, which may form pit stop areas, for example, thus allowing batteries to be replaced and the cars otherwise "serviced".

BRIEF DESCRIPTION OF THE DRAWINGS

An embodiment of the invention will now be described, by way of example, with reference to the accompanying drawings in which:

FIG. 1 is a schematic view of a slot racing track being an embodiment of the invention.

FIG. 2 illustrates two sections of the track shown in FIG. 1, with FIG. 2*a* being a plan view of the track sections, FIG. 2*b* being an enlargement of the circled junction of FIG. 2*a*. FIG. 2*c* being a cross section across C—C' of FIG. 2*b* and FIG. 2*d* being a cross section across D—D' of FIG. 2*b*.

FIG. 3 shows an alternative track section usable with the track of FIG. 1.

FIG. 4 is a schematic plan view of a racing vehicle for use on the track of FIG. 1 with FIG. 4*b* being a schematic side view.

FIGS. 5*a* and 5*b* are schematic views showing the operation of the lane changing mechanism of the vehicle and track.

FIG. 6 illustrates a preferred feature of the vehicle and track for retaining the vehicle on the track, with FIG. 6*a* being a perspective view of a track engagement member of a vehicle, FIG. 6*b* showing the member of FIG. 6*a* engaged with a modified track and FIGS. 6*c* and 6*d* showing operation of the track engagement member.

FIG. 7*a* and 7*b* are views of an embodiment of the invention showing the features of FIG. 5 and 6 in combination.

DETAILED DESCRIPTION OF THE PREFERRED EMBODIMENT

With reference to FIG. 1, an embodiment of slot track racing apparatus according to the invention is shown, which comprises a track generally designated 100 divided up into a plurality of track sections. These track sections comprise, principally, racing track sections 120 which form a continuous circuit and branch track sections 130, which form a pit area.

The racing track sections 120 are shown in more detail in FIGS. 2 and 3.

In FIG. 2, FIG. 2*a* shows two track sections 120 which are connected together in alignment by any suitable means. Each track section is provided with first and second longitudinally extending slots which define lanes 200, 202. Between the slots 200, 202 a plurality of lane changing slots 204, 206 are provided.

FIG. 3 shows an alternative track section in which, instead of the lane changing slots 204, 206 being in series, they are in parallel in a criss-cross arrangement.

The slots are all formed in a base member 208 formed of plastics material. The junction between lane defining slot 202 and lane changing slots 204, 206 is shown in more detail in FIGS. 2*b*-2*d*. The intended direction of travel of racing vehicles (which are described hereinafter) on the track is that as shown by arrows 210. Slots 206 are slanted away from lane 202 whereas slots 204 are slanted away from lane 200. The slots 206 are for vehicles changing from lane 202 to lane 200 and slots 204 are for vehicles changing from lane 200 to lane 202.

At the junction between the lane from which a car is to move and the respective lane changing slot, a lane changing means in the form of a lane changing member 220 is provided. The lane changing member as shown in FIGS. 2*b* and 2*d* partially occludes the slot 202 and has a leading face 222 slanted at an angle the same as the angle of slant of slot 206.

The lane changing member 220 is selectively engageable by a track racing vehicle to allow the vehicle to change lane With reference to FIG. 4*a*, schematic diagram of a vehicle 300 for use on the track 100 is shown. The vehicle is preferably, of ratio 1:30 or 1:32 and comprises a chassis 302 upon which wheels 304, 305 are mounted. Rear wheels 304 are connected via an axle 306 and gearbox 308 to a driving motor 310. A slot engagement member 320 is provided between the front wheels 305. The member 320 is adjustable in position relative to the chassis as shown in more detail in FIG. 5. The slot engagement member 320, which is of substantially cylindrical form is slidably retained in a housing 322 having a circular opening 324 at one end and, except for a retaining ledge 326 is open at the opposed end. The member 320 includes circular lips 328, 330 and between these lips a toothed rack 332 is provided which engages a corresponding pinion 334 connected to a motor 336. A spring 340 is held captive between lip 330 and housing 322 so as to bias the member 320 to the position shown in FIG. 5*a*. When motor 336 is actuated, pinion 334 is rotated anticlockwise thus forcing member 320 to adopt the position showing FIG. 5*b*. It will be noted that in the position shown in FIG. 5*a*, the slot engagement member 320 protrudes into slot 202 sufficiently to be guided thereby but above the level of lane changing member 220, whereas, as shown in FIG. 5*b*, slot engagement member 320 protrudes further into slot 202 below the level of member 220. In use, when motor 336 is actuated, the lowering of member 320 will cause vehicle 300 moving round the track to engage a lane changing member 220 thus causing the vehicle to follow a lane changing slot, e.g. 206, rather than continuing in a racing lane, e.g. 202, which would be the case when motor 336 was not actuated.

Motors 301 and 336 are powered by a battery pack 340 mounted in the vehicle chassis. Control of the motors 301, 336 is provided via a control circuit 342 by a hand held radio control 344, the vehicle 300 and radio controller 344 each being provided with an aerial 346, 348. The radio controller 344 and control circuit 342 are of standard form as used in any radio controlled vehicle where two controls, stop/go and, for example, left/-right (turning the wheels) are provided. The circuit may be simply adapted to control, firstly, the drive motor 310 and, secondly, the control motor 336 (which has only an up/down function). Preferably, both motors have only on/off control (i.e. providing or cutting off power from the battery pack 340 to the motors), with no additional control. However, if desired, there can be a gradual control of motor 310 thus allowing the vehicle 300 to accelerate/decelerate.

In use, two users each have a radio controller 344 controlling their respective vehicle 300 to control both the speed of the vehicle 300 and in which lane the car travels. Thus, one player can maneuver his vehicle to overtake the other and can also take advantage of driving in one lane or the other (e.g. taking the innermost line at a bend, rather than the outermost for which the journey distance will be greater).

A variation of the embodiment of the invention of FIGS. 2-5 is shown in FIG. 6 in which, additionally, means are provided for retaining the vehicle 300 on the track. In this variation, a lane engagement member 350 is provided. The member is of a generally cylindrical form having a central bore 352 running therethrough and provided with circular lips 354, 356 at each end. The member 350 is retained within a cylindrical chamber in chassis 302 as shown in FIG. 6*b* so as to be fully rotatable above the axis of bore 352. The slot structure of the track 100 is slightly modified in that slot 360 is slightly wider than the slot 202 of the embodiment of FIG. 2 and is provided with partial closure members 362, 364 which define therebetween a longitudinal opening 366 through which member 350 protrudes. The member 350 is held in slot 360 by lip 354 thus preventing the car from becoming detached from the track.

The member 350 is rotatable so that if the car wanders from side to side, it will freely rotate thus reducing frictional losses, as shown in FIGS. *6c* and *6d*.

In FIGS. *7a* and *7b* an embodiment of the invention is shown in which the embodiments of FIGS. 5 and 6 are combined. In these figures, reference numerals similar to those of FIGS. 5 and 6 are shown, with the addition of 100, which the addition of reference numeral 470 being a modified lane changing member of increased width in conformity with the widened slot. As can be seen, lane engagement member 420 now passes freely through the central lane of track engagement member 454.

The track 100 shown in FIG. 1 in addition to the racing track sections 120 includes a pit stop area 130. This is comprised of two route changing sections 140 which have a lane changing structure similar to that shown in FIG. *2a* including a single lane changing slot with associated lane changing member being provided to direct a vehicle from the lane adjacent to the pit stop area 130. The pit stop area 130 includes a through lane 142 and three bays 144.

With regard to the embodiments shown in FIGS. 6 and 7, in the pit stop area, the lips 362/4, 462/4 are omitted, so that the vehicle may be removed from the track. Furthermore, the slots in the pit stop area may have a speed retarding surface, for example latex coated sides or be of a narrower width, to reduce speed in the area 130.

Although a motor and track and pinion arrangement has been described for adjusting the position of the slot engaging member, a solenoid may be used instead.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A slot track racing apparatus comprising:

a base member;

first and second slots formed in the member, the slots defining respective lanes;

at least one lane changing slot formed in the member and connecting the first and second slots together; and a lane changing member selectively engageable by a vehicle, the lane changing member partially occluding one of the lane defining slots at a junction between said one of the lane defining sots and the lane changing slot, a leading face of the lane changing member being slanted at the same angle as the lane changing slot, the vehicle including a guide member protruding from the vehicle for engagement in one of said slots to be guided thereby and means for controlling the degree of protrusion from the vehicle for engagement in one of said slots to be guided thereby and means for controlling the degree of protrusion of the guide member to allow selective engagement with the lane changing member independent of vehicle speed.

2. Apparatus as claimed in claim 1 wherein the lane changing slot is provided at a slanted angle between the lanes.

3. Apparatus as claimed in claim 1 wherein two lane changing slots are provided, each lane changing slot being provided at a slanted angle between the lanes, the lane changing slots being slanted in opposite directions.

4. Apparatus as claimed in claim 3 wherein the lane changing slots are disposed in series

5. Apparatus as claimed in claim 3 wherein the lane changing slots cross one another.

6. Apparatus as claimed in claim 1 wherein the controlling means comprising means for urging the guide member in a first direction against a biasing means.

7. Apparatus as claimed in claim 6 wherein said urging means comprises a motor.

8. Apparatus as claimed in claim 6 wherein the vehicle further comprises means for receiving a battery to power said urging means and radio control means for controlling the application of power to said urging means.

9. Apparatus as claimed in claim 8 further comprising a drive motor for powering the vehicle and said radio control means further controls application of power to the drive motor.

10. Apparatus as claimed in claim 1 wherein each slot is partially covered to define a longitudinal extending opening narrower than the width of the slot for receiving said vehicle guide member, which includes a slot engaging member.

11. Apparatus as claimed in claim 10 wherein said slot engaging member has a lip wider than said longitudinal extending opening.

12. Apparatus as claimed in claim 11 wherein the slot engaging member is of cylindrical form and is freely rotatable relative to the chassis of the vehicle, said lip being circular and disposed at one end of the slot engaging member.

13. Apparatus as claimed in claim 12 further comprising a second lip disposed at the opposed end of the slot engaging member, the second lip being coupled to the chassis of the vehicle.

14. A slot racing track comprises a plurality of connectable sections formed by slot track racing apparatus as claimed in claim 1, the sections being connectable to form a continuous circuit.

15. A track as claimed in claim 14 further comprising a route changing section connected to the racing track sections, the route changing section being connected to an alternative track lane and provided with lane changing means to divert a vehicle from the racing track sections to the alternative track lane.

16. A track a claimed in claim 15 wherein the alternative track lane comprises a simulated pit area.

17. In combination, the apparatus as claimed in claim 8 and a radio controller for controlling the vehicle.

18. Apparatus as claimed in claim 6 wherein said urging means comprises a solenoid.

19. A slot racing track on which toy vehicles are raced one against the other by remote controls of the toy vehicles, the track comprising at least two longitudinally extending slots, each said slot being partially covered to define a longitudinally extending opening narrower than the width of said slot for receiving slot engagement members of said toy vehicles, each said slot engagement member provided with a lip wider than said opening for retention in the slot, each said slot engaging member having a cylindrical form and being fully rotatable relative to the chassis of the toy vehicle, each said slot engaging member further including a vertically slidable member received in therein, said vertically slidable member being connected to a control means for sliding the vertically slidable member in and out of the slot engaging member and for selectively changing the travel direction of the toy vehicle.

* * * * *

UNITED STATES PATENT AND TRADEMARK OFFICE

CERTIFICATE OF CORRECTION

PATENT NO. : 5,218,909

DATED : June 15, 1993

INVENTOR(S) : Cody K. M. Ng

It is certified that error appears in the above-indentified patent and that said Letters Patent is hereby corrected as shown below:

In column 5, claim 1, line 50, please delete "sots" and substitute therefor --slots--.

Signed and Sealed this

Twenty-ninth Day of March, 1994

Bruce Lehman

*Attest:*

BRUCE LEHMAN

*Attesting Officer*

*Commissioner of Patents and Trademarks*